United States Patent [19]

Neuroth

[11] Patent Number: 4,675,474

[45] Date of Patent: Jun. 23, 1987

[54] REINFORCED ELECTRICAL CABLE AND METHOD OF FORMING THE CABLE

[75] Inventor: David H. Neuroth, Hamden, Conn.

[73] Assignee: Harvey Hubbell Incorporated, Orange, Conn.

[21] Appl. No.: 772,413

[22] Filed: Sep. 4, 1985

[51] Int. Cl.[4] ..... H01B 7/18

[52] U.S. Cl. ..... 174/102 R; 156/51; 156/52; 156/56; 174/113 R; 174/116; 174/120 AR

[58] Field of Search ..... 174/102 R, 113 R, 116, 174/120 AR, 121 AR, 110 AR; 156/51, 52, 56

[56] References Cited

U.S. PATENT DOCUMENTS

| | | | |
|---|---|---|---|
| 2,544,233 | 3/1951 | Kennedy | 174/116 |
| 2,690,984 | 10/1954 | Crandall et al. | 156/56 |
| 2,727,087 | 12/1955 | Hull | 174/109 |
| 2,930,837 | 3/1960 | Thompson | 174/115 |
| 3,236,939 | 2/1966 | Blewis et al. | 174/110 AR |
| 3,299,202 | 1/1967 | Brown | 174/121 R |
| 3,413,408 | 11/1968 | Robinson | 174/121 R |
| 3,425,865 | 2/1969 | Shelton, Jr. | 428/384 |
| 3,462,544 | 8/1969 | King | 174/113 R |
| 3,566,009 | 2/1971 | Lamond et al. | 174/102 R |
| 3,602,632 | 8/1971 | Ollis | 174/36 |
| 3,602,636 | 8/1971 | Evans | 174/115 |
| 3,649,744 | 3/1972 | Coleman | 174/107 |
| 3,684,644 | 8/1972 | Snell | 428/336 |
| 3,710,007 | 1/1973 | Hoeg et al. | 174/116 |
| 3,742,363 | 6/1973 | Carle | 174/121 AR X |
| 3,832,481 | 8/1974 | Boyd et al. | 174/102 R |
| 3,835,929 | 9/1974 | Suman, Jr. | 166/315 |
| 4,081,602 | 3/1978 | Paniri et al. | 174/103 |
| 4,088,830 | 5/1978 | Wargin et al. | 174/120 AR X |
| 4,096,351 | 6/1978 | Wargin et al. | 174/102 R |
| 4,106,961 | 8/1978 | Kreuger et al. | 156/48 |
| 4,284,841 | 8/1981 | Tijunelis et al. | 174/102 R X |
| 4,409,431 | 10/1983 | Neuroth | 174/103 |
| 4,472,598 | 9/1984 | Boyd et al. | 174/113 R |
| 4,515,993 | 5/1985 | MacKenzie | 174/102 R |

FOREIGN PATENT DOCUMENTS

| | | |
|---|---|---|
| 53-22677 | 7/1978 | Japan . |
| 40453 | 10/1933 | Netherlands . |

*Primary Examiner*—Morris H. Nimmo

*Attorney, Agent, or Firm*—Jerry M. Presson; Alfred N. Goodman

[57] ABSTRACT

A reinforced electrical cable having a plurality of conductor assemblies in an armor covering, and filler material filling the interstices between the conductor assemblies and the armor covering, and the method of forming the cable. Each conductor assembly includes a core of conducting material, a layer of insulation which surrounds the core, a second layer of chemical barrier material which surrounds the first layer and a layer of reinforcing material surrounding the insulation layer. The plurality of conductor assemblies are then arranged as desired and the filler material (in the unvulcanized state) is placed around and between the conductor assemblies. The quantity of filler material placed between and around the conductor assemblies is sufficient to fill the interior of the armor covering in its unvulcanized state. The armor covering is next placed around the conductor assemblies and the filler material. The unvulcanized filler material conforms to the interior of the armor covering. The entire assembly is then vulcanized. As a result of this heating, the layers of insulation and the filler material expand outwardly, both thermally and chemically. This places the cable assembly in compression.

19 Claims, 10 Drawing Figures

REINFORCED ELECTRICAL CABLE AND METHOD OF FORMING THE CABLE

FIELD OF THE INVENTION

This invention relates to reinforced insulated electrical cable and the method of forming the cable. In particular, this invention relates to electrical cables having a plurality of spaced conductor assemblies, filler material surrounding and separating the conductor assemblies and an outer covering of metal, each conductor assembly including a core of conducting material surrounded by layers of insulating, protective and reinforcing materials, and the method of making the same.

The cable is especially useful in oil wells where it is exposed to high pressures. The cable according to this invention is more resistant to pressure changes in its environment than prior cables, such pressure changes commonly occurring as the cable is removed from the well or when pressure in the well is reduced, as during a pump down.

BACKGROUND OF THE INVENTION

Electrical cables are used extensively in oil wells to transmit electricity from above ground power units to pumps located many feet below the earth's surface. These cables must be able to survive and perform satisfactorily under extremely adverse conditions of heat, mechanical stress and pressure. In particular, these cables experience down-hole pressures which can be in the hundreds or thousands of pounds per square inch. Typically, the insulation surrounding the conductors in the cable contains micropores into which gas is forced at these high pressures over a period of time. Then, when the cable is rather quickly extracted from the well, or when the fluid level in the well is rapidly reduced, there is not sufficient time for the intrapore pressure to bleed off. As a result, the insulation on the cable tends to expand like a balloon and may rupture.

Presently, most high temperature and pressure oil well round cables are made by taking three stranded elements of conducting material, filling each of the strands with a blocking agent to prevent gas migration along each strand, insulating each strand with an appropriate insulation material, surrounding the insulation with a tape, sold under the registered trademark Tedlar, placing a braid of treated nylon over the Tedlar tape, cabling the three conductors about a central filler cord made of insulated string, surrounding the three conducting assemblies with a filler material and then armoring the entire cable assembly.

However, while there has been much work in this area of protecting down-hole insulated electrical cables to avoid explosive decompression by adding reinforcing layers, there are numerous disadvantages to this prior art. These disadvantages include the fact that many of the prior art cables are extremely expensive to manufacture, are bulky, will still rupture under adverse conditions and include numerous extra layers of protective material.

Examples of such cables are disclosed in the following U.S. Pat. Nos. 2,690,984 to Crandall et al.; 2,930,837 to Thompson; 3,299,202 to Brown; 3,425,865 to Shelton, Jr.; 3,602,632 to Ollis; 3,602,636 to Evans; 3,649,744 to Coleman; 3,684,644 to Snell; 3,742,363 to Carle; 3,835,929 to Shuman, Jr.; 4,096,351 to Wargin et al.; 4,106,961 to Kreuger et al. and 4,409,431 to Neuroth, and Japanese Pat. No. 22,677 to Fujikura.

In addition, cables have been developed in which the filler material is placed between or around the conducting assemblies in the unvulcanized state and is in turn surrounded by a metallic or non-metallic sheath or outer covering without undergoing vulcanization. The entire cable structure is then heated until the filler material vulcanizes, thus bonding either partially or completely, the filler material to the outer covering. Examples of these cables are disclosed in the following U.S. Pat. Nos.: 2,544,233 to Kennedy; 2,727,087 to Hull; 3,236,939 to Blewis et al; 3,413,408 to Robinson; and 3,462,544 to King.

However, these cables still possess the disadvantages of the first group of cables enumerated above, including that the cables may still rupture under adverse conditions, are relatively expensive to manufacture and are unnecessarily bulky.

Therefore, it is apparent from the above that there exists a need in the art for an electrical cable which is inexpensive, less bulky, more resistant to rupture and yet transmits electricity effectively. This invention addresses this need, as well as other needs which will become apparent to those skilled in the art, once given this disclosure.

SUMMARY OF THE INVENTION

Generally speaking, this invention provides a reinforced electrical cable comprising a plurality of conductor assemblies, each of the conductor assemblies comprising a core of conducting material, a layer of insulation surrounding the core, and a layer of reinforcing material surrounding the layer of insulation; an armor covering in which the conductor assemblies are located and filler material filling the interstices between the conductor assemblies and the armor covering; wherein the filler material is vulcanized and the cable is formed by placing the filler material in the interstices in the unvulcanized state such that the filler material fills the interior of the armor covering, and then vulcanizing the filler material.

This invention also fulfills the above needs in the art by providing a method of constructing a reinforced electrical cable comprising the steps of forming a plurality of conductor assemblies by providing a plurality of cores of conducting material, surrounding each core with a layer of insulation, surrounding each layer of insulation with a layer of reinforcing material, placing the plurality of conductor assemblies in adjacent positions, placing a vulcanizable filler material between and around the conductor assemblies, placing an armor covering around the conductor assemblies and filler material, and heating the cable until the filler material is vulcanized; wherein the step of placing filler material between and around the conductor includes placing an amount of filler material around and between the conductor assemblies sufficient to fill the armor covering in the unvulcanized state.

The cable may be a round cable including three conductor assemblies which are arranged as the points of a triangle. The cable may include a signal conductor which is located at the center of this triangle and extends longitudinally within the cable.

In some embodiments, the reinforcing material may have spaced holes therein to allow gases to pass through the reinforcing material.

The armor covering may have ripples, dimples, or any other type of irregularities in its surface. The quantity of filler material inserted in the cable may be selected so that the unvulcanized filler material, when the armor covering is placed around it, fills all the ripples, dimples, etc. in the armored covering.

The cables according to this invention have many advantages over the present reinforced electrical cables. Among these advantages are that the cables according to this invention are relatively small and lightweight. Size and weight are important in many applications of such cable, for example in oil wells as discussed above. It is important that the cable be as small and light as possible so that it does not take up much room in the oil well shaft and is easy to handle and maneuver.

A further advantage of the cables according to this invention is that these cables enjoy greater decompression strength since a dense, void-free product results when the cable is constructed as taught herein.

Another advantage of cables according to this invention is that the cables are less costly to manufacture than the prior cables. If desired, a solid copper or another solid metallic conductor can be used instead of a stranded conductor. Moreover, the reinforcing material can be extruded around the insulation layer instead of braiding a material around the insulation, such as a braid of nylon, which is commonly done in producing the prior art cables. Moreover, many of the prior art devices have to be heated twice before they are finally armored. Cables according to this invention are heated once before and once after all the elements have been placed within the armor covering. The latter heating is to vulcanize the filler material within the armor covering.

A further advantage is that when cables are constructed by the method disclosed herein, no uneven pressures resulting from the forming of the cable assembly are produced, as are often produced in the prior methods. The cable core is brought to a state of hydrostatic equilibrium before the filler material is vulcanized.

Further, since the entire cable is not heated until it is placed within the armor, the armor acts as a mold.

Yet another advantage of cables according to this invention is that the cables tend to be cooler in use because there is less insulation than in the prior cables and the amount of air trapped under the armor covering is greatly reduced.

Those embodiments of this invention which include an armor covering with a rippled, dimpled or otherwise deformed inside surface and in which the filler material fills the inside protrusions in the armor covering so as to interlock the filler material to the armor covering have further advantages over the present cables. One such advantage is that the conductor assemblies and filler material will not slide with respect to the outer covering. This has been a problem with the prior cable assemblies, especially when the cable has to be supported by an armor covering. This also reduces the possibility of the armor covering splitting during sharp bending.

Further, these embodiments have the advantage that the cable assembly has enhanced impact and crush resistance. Any impact on the armor covering which would tend to dent the armor covering is resisted by the filler material. Since the filler material is essentially incompressible and substantially fills the interior of the armor covering, the impact has to be of sufficient severity to displace the filler material before it can deform the armor covering.

Yet another advantage of these embodiments is that, when the cable is in service in a hot well, gases cannot flow between the exterior of the filler material and the interior of the armor covering since there is no gap therebetween as in the present cables. The hot cable is completely "gas blocked". This enables one to more conveniently handle the cable as it does not have to be removed in the packer section and penetrators of the well head as some of the present cable.

A further advantage of these embodiments is that in service the filler material and armor covering form a gasket-like seal which further enhances the decompression strength of the cable and adds to its longevity by reducing the area of exposure of the cable core to well fluids.

Other objects, advantages and salient features of the invention will become apparent from the following detailed description, which, when taken in conjunction with the drawings, discloses a preferred embodiment of this invention.

Certain embodiments of this inventio will now be described with respect to these drawings.

DETAILED DESCRIPTION OF THE DRAWINGS

Figure 1:
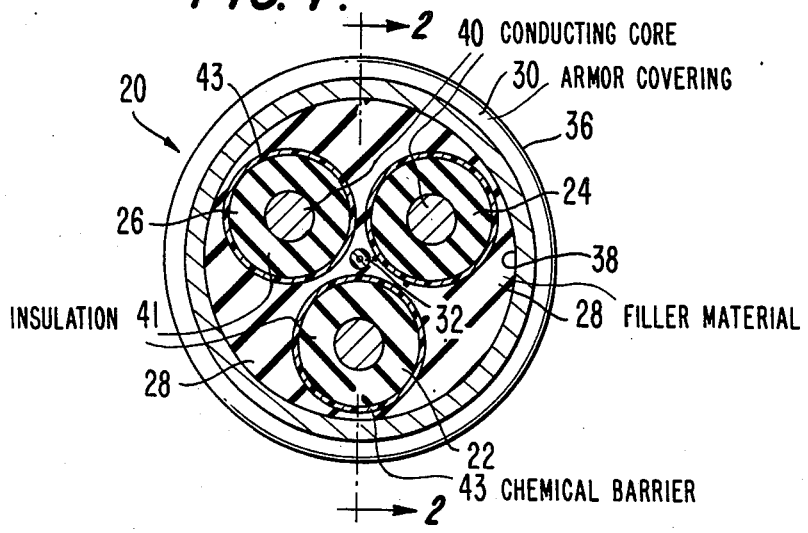
FIG. 1 is a cross-sectional view of one embodiment of this invention, prior to the cable assembly being heated and the filler material vulcanized.
Figure 2:
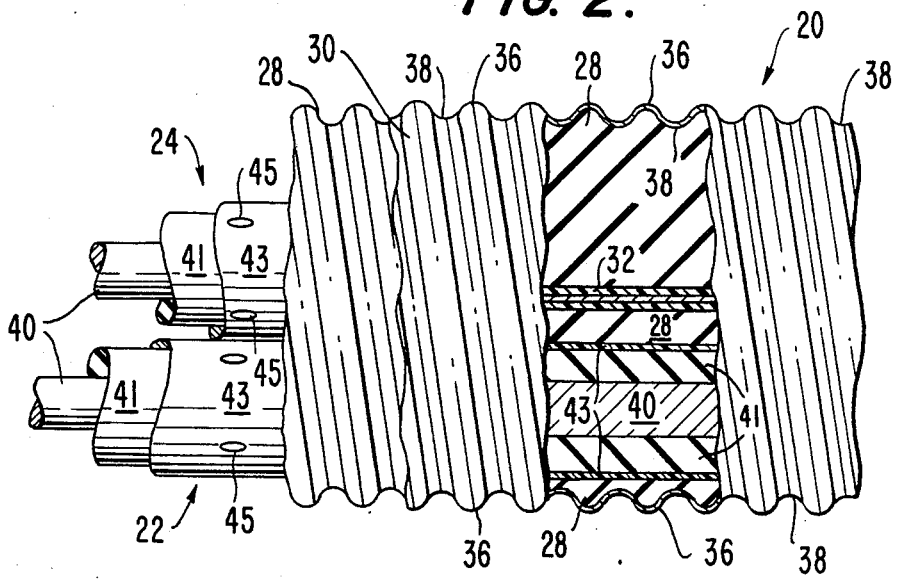
FIG. 2 is a partial side view of the embodiment of this invention illustrated in FIG. 1 having a partial cutaway taken along line 2—2 of FIG. 1.

Referring to the Figures, in particular FIGS. 1 and 2, a reinforced electrical cable according to this invention, cable 20, is illustrated including three conductor assemblies 22, 24 and 26, filler material 28, armor covering 30 and signal conductor 32. Conductor assemblies, or power lines, 22, 24 and 26 are all of the same design and include core 40 of conducting material, surrounded by a layer of insulating material 41 and a layer of Kynar 43, which is a brand of polyvinylidene fluoride sold by Pennwalt Corp.

Conductor assemblies 22, 24 and 26 are positioned such that an equilateral triangle is formed by lines connecting their center points (see FIG. 1). Filler material 28 can be of any of the well known materials employed to insulate electrical cable, including material sold under the registered trademark Kerite SP-50 (an EDR-/EDPM insulation) or a variation thereof. It is preferable that the filler material be vulcanizable, for reasons discussed below. It has been discovered that optimum results are obtained when filler material 28 is a high viscosity material having a Mooney viscosity measured at 212° F. of 50–130.

Armor covering 30 can be and is preferred to be metallic, but it could be non-metallic. Armor covering 30 has helical ripples therein forming peaks 36 and valleys 38 (see FIG. 2).

Signal conductor 32 is an elongated member which runs approximaately down the center of cable 20, also at the center of the three conductor assemblies 22–26. Signal conductor 32, in the embodiment illustrated in the Figures, is comprised of a copper core having a layer of material sold under the registered trademark Teflon, which is a brand of polytetrafluoroethylene sold by DuPont Company, around it with a outer layer of filler material around the Teflon layer.

As stated above, in this embodiment, conductor assemblies 22, 24 and 26 are of the same design. Thus, the following discussion pertains equally to conductor assemblies 22, 24 and 26.

Core 40 is comprised of strands of conducting material or is a single solid conductor. The advantages of using a solid conductor compared to a core comprised of strands of conducting material are a reduction in the cost of the conductor assembly, reduction in the diameter of the conducting core and elimination of the need to fill the strands assembly to prevent gas from traveling longitudinally along the conductor.

Core 40 is surrounded by layer of insulation material 41. Layer 41 can be comprised of any of the well known insulating materials including Kerite SP-50. Layer 41 can be extruded and vulcanized around core 40, or applied using any of the current methods of applying a layer around an elongated wire.

Next, layer 43 of Kynar is applied around insulation layer 41. Other chemical barrier materials can be employed in place of Kynar. Layer 43 may be extruded around layer 41 or it can be applied using any of the well-known methods for applying such materials. In some embodiments, layer 43 is approximately 0.15" thick.

Perforations 45 can be formed in layer 43 (see FIG. 2), if desired, to more freely allow migration of gases during decompression of the cable. Perforations 45, as illustrated in FIG. 2 are arranged in spaced circumferential rows. Perforations 45 are optional, depending on the design of the cable 20.

After conductor assemblies 22, 24 and 26 have been formed, they are arranged as points of a triangle and may be cabled, i.e., twisted together. The interstices between assemblies 22, 24 and 26 are then filled with filler material 28 and filler material 28 is placed around the grouping of assemblies 22, 24 and 26. Filler material 28 is applied in the unvulcanized state. The volume of filler material 28 is chosen such that the interior of armor covering 30 is completely filled by filler material 28 when armor covering 30 is placed around conductor assemblies 22, 24 and 26 and filler material 28.

As stated above, covering 30 is then placed around filler material 28. Armor covering 30 may have a thickness of approximately 0.034".

Since filler material 28 has a flowable consistency when armor covering 30 is applied, the exterior of filler 28 will conform to the shape of the interior of armor covering 30 (with complementary peaks and valleys during the armoring procedure) and, as stated above, completely fills the interior of armor covering 30. If armor covering 30 was stripped from cable assembly 28 at this time, the exterior of filler material 28 would be the exact imprint of the interior of armor covering 30. In effect, the filler material 28 is locked into armor covering as if armor covering 30 had been threaded or screwed onto filler material 28 as seen in FIG. 2.

One method of armoring the uncompleted cable assembly is by passing it through an armoring machine which wraps a tape of armoring material around the uncompleted cable in an advancing helix, forming a tube. The various windings of the tape interlock and the resulting tube is a completed cylinder. Any other armoring method may be employed in the practice of this invention.

Once the cable assembly has been armored, it undergoes a heating operation. The heating operation performs two functions. The first function is the vulcanization of filler material 28. The second function is the thermal expansion of insulating layer 41 and of filler material 28. This thermal expansion places the interior of cable assembly 20 in compression. This may stretch armor covering 30 or may even cause some of the filler material 28 to be pushed out through laps or between windings of the armor tape. As stated above, this creates a dense, void-free end product.

When cable assembly 20 is removed from the heat source and cools to ambient, i.e., room, temperature, filler material 28 may retract somewhat from the interior of armor covering 30. Then, when cable assembly 20 is inserted into a high temperature or high pressure environment, thermal expansion of cable assemblies 22, 24 and 26 and filler material will reoccur, thus pushing filler material 28 back into contact with the interior of armor covering 30.

Figure 10:
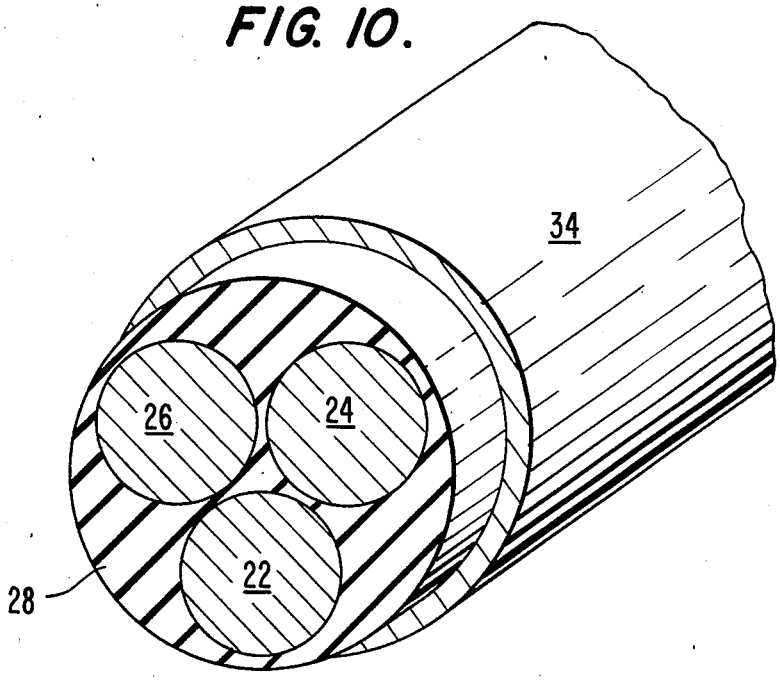
FIG. 10 is a cross-sectional view of three conductor assemblies and filler material (prior to the placement of an armor covering around them) wrapped by a retaining tape.

In some embodiments of this invention, a thin tape, such as tape 34 in FIG. 10, may be applied around conductor assemblies 22, 24 and 26 and filler material 28 as a handling aid. Tape 34 may be approximately 0.001" thick and may be comprised of polypropylene. It prevents the unvulcanized filler material 28 from sticking together as the cable assembly is transported to the armoring machine. This may be necessary if the cable assembly (without the armor covering) is stored or transported on a reel.

Figure 3:
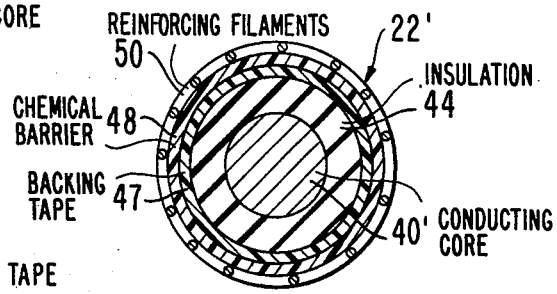
FIG. 3 is a cross-sectional view of a second conductor assembly which can be employed in the practice of this invention.

Other embodiments of conductor assemblies which can be employed in the practice of this invention are illustrated in FIGS. 3–9. Turning first to FIG. 3, conductor assembly 22′ includes core 40′, insulation layer 44, chemical barrier layer 48 on a nylon backing tape 47 and serving 50 of reinforcing filaments. Each successive layer is applied around the preceding layer such that a series of hollow cylinders is formed around core 40′. The individual layers will be described in more detail below with respect to the embodiments illustrated in FIGS. 4 and 5.

Figure 4:
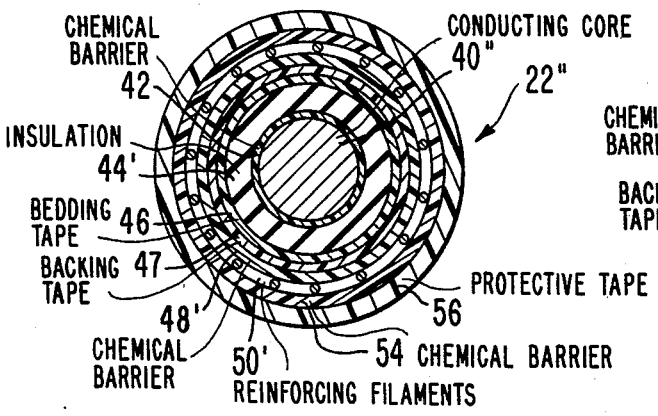
FIG. 4 is a cross-sectional view of a third conductor assembly which can be employed in the practice of this invention.
Figure 5:
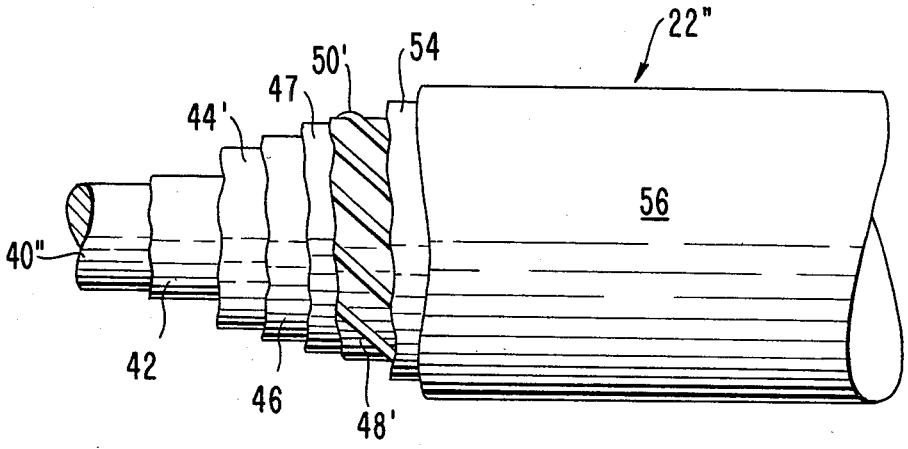
FIG. 5 is a partial side view of the conductor assembly illustrated in FIG. 4, showing the various layers of the conductor assembly in a stepped arrangement.

Turning next to the embodiments illustrated in FIGS. 4 and 5, conductor assembly 22″ has a core 40″ of conducting material, a first layer 42 of chemical barrier material, a layer 44′ of insulating material, Tedlar bedding tape 46 (a brand of polyvinyl fluoride sold by DuPont Co.), nylon backing tape 47, a second layer 48′ of chemical barrier material, a serving of reinforcing filaments 50′, chemical barrier material 54, and protective tape 56, which could be a nylon backing tape. As before, each successive layer is applied around the preceding layer such that a series of hollow cylinders is formed around core 40″.

First layer 42 of chemical barrier material directly surrounds core 40″ in this embodiment and may be comprised of materials sold under the registered trademarks Teflon, Kynar and Peek (a brand of polyetheretherketone sold by ICI, Inc.), or other material having good chemical stability and good dielectric strength. The purpose of layer 42 is to chemically protect the conducting core 40″ and to provide a backup dielectric in case insulation layer 44′ is penetrated, dissolved or otherwise rendered ineffective.

The inclusion of chemical barrier layer 42 is optional in the practice of this invention; however, inclusion of the layer may result in a better signal transmission, a higher temperature rating of the complete cable and will result in the cable having higher IR readings.

Insulation layer 44′ directly surrounds chemical barrier layer 42. In embodiments not including chemical barrier layer 42, insulation layer 44′ directly surrounds and is in contact with core 40″ (see, for example, FIG. 3). Insulation layers 44 and 44′ can be comprised of any of the well known insulating materials, including Kerite SP-50.

Next in the embodiment illustrated in FIGS. 4 and 5, Tedlar bedding tape 46 is applied around the exterior of insulation layer 44′. Tedlar bedding tape 46 is an optional layer and may be omitted from certain embodiments of this invention, if desired. Tedlar bedding tape 46 is provided in the embodiment illustrated in FIGS. 3 and 5 to keep insulation layer 44′ and chemical barrier layer 48′ (described below) separated. If layers 47, 48 and 48′ are omitted, layer 46 serves to prevent elements 50 and 50′ from pressing into insulation layer 44 and 44′.

Chemical barrier layers 48, 48′ and 54 are comprised of a material which is vulcanizable at between 200° F. and 300° F. Layers 48, 48′ and 54 are 0.005″–0.015″ thick in this embodiment and may be comprised of the same material as filler material 28.

Servings of filaments 50 and 50′ are comprised of a number of spaced strands of filaments. The filaments may be comprised of Kynar, fiberglass, boron, Monel (a brand of nickel-copper alloy sold by International Nickel Co.) or any other of the well known materials having similar properties. These specific materials are preferable over nylon, which is commonly employed in the prior art, since these materials are more stable in oil well and other environments.

The spacing of the individual filaments of servings 50 and 50′ can be varied as desired. It has been found that for optimum results, 10% to 100% of the chemical barrier layers 48 and 48′ should be covered by serving 50. It has also been found that the preferred lay length of the filaments is one quarter inch to one inch. The most optimum coverage is believed to be 50% and the optimum lug length is believed to be one half of an inch. If desired, a second serving filaments, serving 52 (see FIG. 7), can be applied directly over the first serving. In the embodiment illustrated in FIG. 7, the second serving 52 is wound in the reverse direction as the first serving 50. Servings 50 and 52 hold insulation layer 44 inward as the cable undergoes decompression.

One advantage of using servings, such as servings 50 and 52, instead of a braided covering, is that the servings can be more quickly applied around chemical barrier layers 48 or 48′ than a braid.

Chemical barrier material 54 is an optional layer which may be provided around serving 50′ (and 52, if included). Chemical barrier material 54 is included to further insulate conducting core 40″ and to assure that the servings 50 and 52 are completely embedded in chemical barrier material (see discussion below).

Protective tape 56 is provided around the chemical barrier material 54 to prevent the chemical barrier material 54 from adhering to filler material 28. Protective tape 56 can be comprised of polypropylene, material sold under the registered trademark Mylar (a brand of polyethylene terephthalate sold by DuPont Co.), nylon fabric or other materials having similar properties.

Conductor assembly 22″ is formed by first taking core 40″, and applying a layer of chemical barrier material completely around core 40″ to form chemical barrier layer 42. Layer 42 can be either in a tape form or it can be extruded around core 40″. Next, insulation layer 44′ is placed around chemical barrier layer 42. Insulation layer 44′ can either be in the shape of a sheet which is wrapped around chemical barrier layer 42 or it can be extruded around chemical barrier layer 42.

Tedlar bedding tape 46 is then wrapped around insulation layer 44′. Second chemical barrier layer 48′ is applied around Tedlar bedding tape 46. Chemical barrier layer 48′ can either be in the form of a tape with or without an inner layer of nylon backing tape 47 or it can be extruded around Tedlar bedding tape 46.

Figure 6:
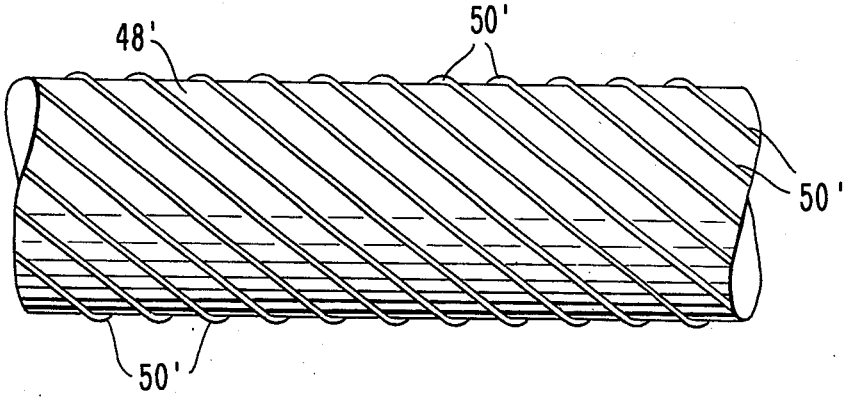
FIG. 6 is a partial side view of a partially constructed conductor assembly as illustrated in FIGS. 4 and 5, illustrating a serving of filaments wrapped around the second chemical barrier layer.
Figure 7:
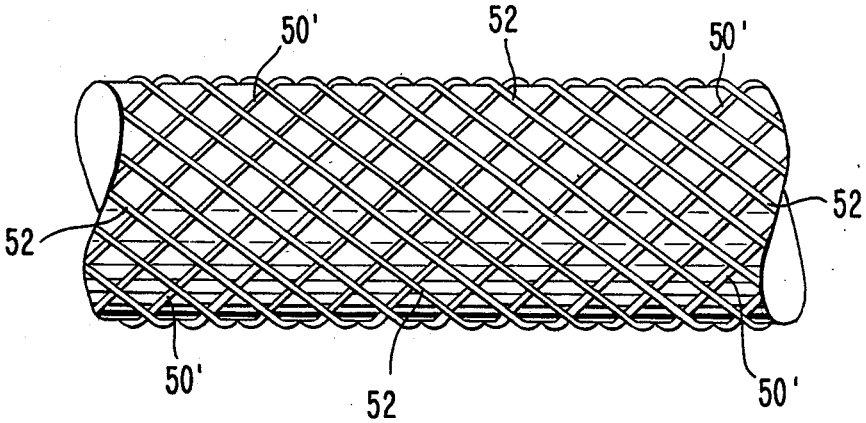
FIG. 7 is a partial side view of a partially constructed conductor assembly according to FIGS. 4 and 5 illustrating a double reverse wrapping of filaments around the second chemical barrier layer.
Figure 8:
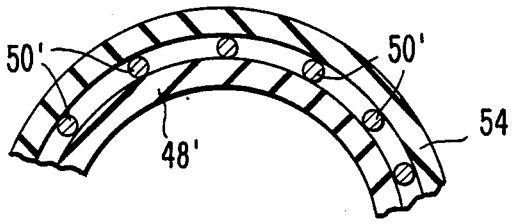
FIG. 8 is an enlarged cross-sectional view of the second layer of chemical barrier material, the serving of filaments, and the third layer of chemical barrier material of the embodiment of this invention illustrated in FIGS. 4 and 5, prior to the heating of the entire cable.
Figure 9:
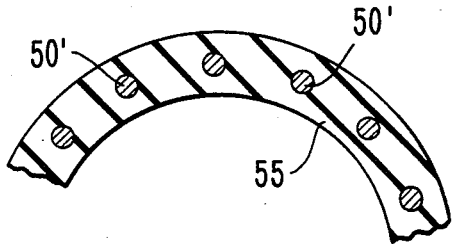
FIG. 9 is an expanded cross-sectional view of the second layer of chemical barrier material, the serving of filaments, and the third layer of chemical barrier material after the cable has been heated to between 250° F. and 300° F. and the chemical barrier material has thermoset.

Next, the serving 50′ of filaments is wrapped around chemical barrier layer 48 (see FIG. 6). If desired, a second serving 52 of filaments can then be wrapped around serving 50′ in the reverse direction from serving 50′ (see FIG. 7). Next, chemical barrier material 54 and protective tape 56 are successively wrapped around the conductor assembly. After this has been completed, the individual conductor assembly 22″ has been formed. Conducting assemblies 24 and 26 can of course be constructed of the same layers and in the same manner.

Next, the conductor assemblies 22, 24 and 26 are arranged as points in a triangle around signal conductor 32. Filler material 28 is then placed around conductor assemblies and a tape of polypropylene, cotton, nylon or similar material can be placed around the filler material, if desired or if necessary.

The cable assembly as formed can then be wound up uncured on a pickup reel. The cable assembly can be stored or transported on this pickup reel.

Next, the cable assembly is unwound from the pickup reel and placed in armor covering 30 as previously discussed.

Next, the entire cable assembly is heated to between 250° to 350° F. and kept at that temperature for a desired length of time. During this heating, the insulation layer 44', the chemical barrier layers 48' and 54 and the filler material expand thermally and sometimes expand chemically (by chemical reactions which result in foaming of the material), depending on the amount of pressure present at the time. This expansion will cause the chemical barrier layer 48' to expand outward and encompass serving 50' (and 52 if provided) such that serving 50' (and 52) becomes embedded within chemical barrier layer 48'. If chemical barrier material 54 is provided, chemical barrier layer 48' and chemical barrier material 54 may become integral at these temperatures (see FIG. 8 which illustrates chemical barrier layer 48', serving 50' and barrier material 54 prior to heating and FIG. 9 which shows the same three elements after heating and as integrated). This thermal and chemical expansion places the interior of the cable assembly in compression as discussed above.

Other embodiments of this invention may include the core and layers in the FIG. 3 embodiment plus any of the layers that are in the embodiment illustrated in FIGS. 4 and 5 but missing from the FIG. 3 embodiment, or any combination of these layers. For example, some embodiments may include the FIG. 3 embodiment plus chemical barrier material 54, layer 42 of chemical barrier material or both layers 42 and 54. Any combination of layers 42, 46, 47, 52, 54 and 56 can be added to the FIG. 3 embodiment.

Once given the above disclosure, many other embodiments, modifications and improvements will become apparent to those skilled in the art. Such other embodiments, improvements and modifications are considered to be within the scope of this invention as defined by the following claims:

I claim:

1. A reinforced electrical cable comprising:

a plurality of conductor assemblies, each of said conductor assemblies comprising
- a core of conducting material,
- a layer of insulation surrounding said core, and
- a layer of reinforcing material surrounding said layer of insulation;

a tubular armor covering having a fixed cross section and an irregular inner surface;

said conductor assemblies being located within said armor covering; and vulcanized filler material filling the interstices between said conductor assemblies and surrounding said conductor assemblies, said vulcanized filler material including an outer irregular surface having a maximum transverse dimension less than the maximum transverse dimension of said irregular inner surface of said armor covering and having the same configuration as the irregular inner surface of said armor covering.

2. A reinforced electrical cable according to claim 1 wherein the reinforcing material is comprised of polyvinylidene fluoride.

3. A reinforced electrical cable according to claim 1 wherein said layer of reinforcing material has spaced perforations therein.

4. A reinforced electrical cable according to claim 1 wherein said armor covering inner surface has ripples therein.

5. A reinforced electrical cable according to claim 1 wherein said core is a solid conductor.

6. A reinforced electrical cable according to claim 1 wherein each of said conductor assemblies further comprises a layer of chemical barrier material surrounding said layer of insulation and another layer of chemical barrier material located between said core and said layer of insulation.

7. A reinforced electrical cable according to claim 6 wherein said layers of chemical barrier material are chemically stable and are dielectric.

8. A reinforced electrical cable according to claim 7 wherein the conductor assembly further comprises a bedding tape located between said layer of insulation and said layer of chemical barrier material.

9. A reinforced electrical cable according to claim 7 wherein the conductor assembly further comprises a backing tape located between said layer of insulation and said layer of chemical barrier material.

10. A reinforced electrical cable according to claim 7 wherein said layers of chemical barrier material have been vulcanized.

11. A reinforced electrical cable comprising:

a plurality of conductor assemblies, each of said conductor assemblies comprising
- a core of conducting material,
- a layer of insulation surrounding said core, and
- a layer of reinforcing material surrounding said layer of insulation;

an armor covering;

said conductor assemblies being located within said armor covering;

filler material filling the interstices between said conductor assemblies and said armor covering;

wherein said filler material is vulcanized and said cable is formed by placing said filler material in the interstices in the unvulcanized state such that the filler material fills the interior of said armor covering, and then vulcanizing said filler material, and a polypropylene tape positioned between said filler material and said armor covering.

12. A method of constructing a reinforced insulated electrical cable comprising the steps of forming a plurality of conductor assemblies by
- providing a plurality of cores of conducting material,
- surrounding each core with a layer of insulation, and
- wrapping a layer of reinforcing material around each layer of insulation, placing the plurality of conductor assemblies in adjacent positions, placing an unvulcanized filler material between and around the conductor assemblies, placing an armor covering around the conductor assemblies and filler material, heating the cable until the filler material is vulcanized, wherein the step of placing filler material between and around the conductor assemblies includes placing an amount of filler material around and between the conductor assemblies sufficient to fill the armor covering in the unvulcanized state, and placing a thin tape of polypropylene around the conductor assemblies and the filler material prior to the placing of the armor covering around the conductor assemblies and filler material.

13. A method of constructing a reinforced insulated electrical cable comprising the steps of forming a plurality of conductor assemblies by
providing a plurality of cores of conducting material,
surrounding each core with a layer of insulation, and
wrapping a layer of reinforcing material around each layer of insulation,
placing the plurality of conductor assemblies in adjacent positions,
placing an unvulcanized filler material between and around the conductor assemblies,
placing an armor covering around the conductor assemblies and filler material, and
heating the cable until the filler material is vulcanized,
wherein the step of placing filler material between and around the conductor assemblies includes placing an amount of filler material around and between the conductor assemblies sufficient to fill the armor covering in the unvulcanized state, and
further comprising the step of placing the cable in compression during the heating of the cable.

14. A method of constructing a reinforced insulated electrical cable comprising the steps of
forming a plurality of conductor assemblies by
providing a plurality of cores of conducting material,
surrounding each core with a layer of insulation, and
wrapping a layer of reinforcing material around each layer of insulation,
placing the plurality of conductor assemblies in adjacent positions,
placing an unvulcanized filler material between and around the conductor assemblies,
placing an armor covering around the conductor assemblies and filler material, and
heating the cable until the filler material is vulcanized,
wherein the step of placing filler material between and around the conductor assemblies includes placing an amount of filler material around and between the conductor assemblies sufficient to fill the armor covering in the unvulcanized state,
wherein the third placing step includes contacting the outer surface of the unvulcanized filler material with the inner surface of the armor covering.

15. A reinforced electrical cable comprising:
a plurality of conductor assemblies, each of said conductor assemblies comprising
a core of conducting material,
a layer of insulation surrounding said core, and
a layer of reinforcing filaments surrounding said layer of insulation;
an armor covering of predetermined cross-sectional size and shape and having an irregular inner surface, said conductor assemblies being located within said armor covering; and
unvulcanized filler material filling the interstices between said conductor assemblies and said armor covering in the unvulcanized state and having an irregular outer surface having the same configuration as the irregular inner surface of said armor covering.

16. A reinforced power cable comprising:
at least one power line;
a tubular armor covering having a fixed cross section and an irregular inner surface;
said at least one power line being located within said armor covering; and
vulcanized filler material surrounding said at least one power line and located inside said armor covering,
said vulcanized filler material including an outer irregular surface having a maximum transverse dimension less than the maximum transverse dimension of said irregular inner surface of said armor covering and having the same configuration as said irregular inner surface of said armor covering.

17. A method of constructing a reinforced power cable comprising the steps of
surrounding at least one power line with an unvulcanized filler material,
placing a tubular armor covering around the at least one power line and filler material, and
heating the cable until the filler material is vulcanized,
the surrounding step including using a volume of filler material at least equal to the volume of the armor covering minus the volume of the at least one power line.

18. A reinforced power cable comprising:
at least one power line;
a tubular armor covering having a fixed cross section and an irregular inner surface;
said power line being located within said armor covering; and
unvulcanized filler material surrounding said at least one power line and located inside said armor covering,
said unvulcanized filler material contacting all of said irregular inner surface of said armor covering and having an irregular outer surface having the same configuration as the irregular inner surface of said armor covering.

19. A method of constructing a reinforced power cable comprising the steps of
surrounding at least one power line with an unvulcanized filler material, and
placing a tubular armor covering around the at least one power line and filler material,
the surrounding step including using a volume of filler material at least equal to the volume of the armor covering minus the volume of the at least one power line.

* * * * *